US008683753B2

(12) United States Patent
Bachorz et al.

(10) Patent No.: US 8,683,753 B2
(45) Date of Patent: Apr. 1, 2014

(54) ENCLOSURE FOR SECONDARY DISTRIBUTION MODULAR SWITCHGEARS

(75) Inventors: Lukasz Bachorz, Opalenica (PL); Jerzy Flis, Warsaw (PL); Bartosz Kopczynski, Warsaw (PL); Jerzy Obojski, Kraków (PL); Michal Wielgos, Ostroleka (PL); Mariusz Wilniewczyc, Warsaw (PL)

(73) Assignee: ABB Technology AG, Zurich (CH)

( * ) Notice: Subject to any disclaimer, the term of this patent is extended or adjusted under 35 U.S.C. 154(b) by 67 days.

(21) Appl. No.: 13/321,568

(22) PCT Filed: May 23, 2010

(86) PCT No.: PCT/PL2010/000038

§ 371 (c)(1),
(2), (4) Date: Nov. 21, 2011

(87) PCT Pub. No.: WO2010/138007

PCT Pub. Date: Dec. 2, 2010

(65) Prior Publication Data

US 2012/0066985 A1 Mar. 22, 2012

(30) Foreign Application Priority Data

May 25, 2009 (PL) ..... P388107

(51) Int. Cl.
*E04H 5/04* (2006.01)
*E04B 5/14* (2006.01)
*E04B 5/29* (2006.01)

(52) U.S. Cl.
CPC .. *E04H 5/04* (2013.01); *E04B 5/14* (2013.01); *E04B 5/29* (2013.01)
USPC ..... 52/79.5; 52/589.1; 52/264

(58) Field of Classification Search
CPC ..... E04H 5/04; E04B 5/10; E04B 5/23; E04B 5/14; E04B 5/29; E04C 3/04
USPC ..... 52/79.9, 79.1, 79.5, 589.1, 264
See application file for complete search history.

(56) References Cited

U.S. PATENT DOCUMENTS 1,721,198 A * 7/1929 Athey ..... 135/149
1,825,195 A * 9/1931 McAvoy et al. ..... 52/127.12

(Continued)

FOREIGN PATENT DOCUMENTS

AU 2008100942 10/2008 ..... E04B 1/38
DE 85 09 797 5/1985 ..... E04H 5/04

(Continued)

OTHER PUBLICATIONS

Polish Search Report in priority application No. P 388107 mailed Jun. 16, 2009.

(Continued)

*Primary Examiner* — Brent W Herring
(74) *Attorney, Agent, or Firm* — Renner Kenner Greive Bobak Taylor & Weber

(57) ABSTRACT

The subject of the invention is an enclosure for secondary distribution modular switchgears, applicable in protecting switchgears both against adverse weather conditions and against unauthorized inspections of high, medium and low voltage switch gear, and also against accidental access by unauthorized persons, or by wild animals and birds.

The inventive enclosure containing a base-frame (3) to which the enclosure walls are attached and which is provided with a roof cover is characterized in that the base frame (3) is formed by a metal truss and contains two extreme base-frame modules, the left one (20) and the right one (23,) and at least one middle module (21 and/or (22) which are connected with one another by means of a pair of permanent connections formed by a socket (27*a*) and a prong (27*b*) and fastening and earthing plates (28*a*, 28*b*).

11 Claims, 11 Drawing Sheets

(56) References Cited

U.S. PATENT DOCUMENTS

| | | | | |
|---|---|---|---|---|
| 2,927,736 | A * | 3/1960 | Rohatyn | 236/49.3 |
| 2,943,717 | A | 7/1960 | Latzko | |
| 2,952,799 | A * | 9/1960 | Wortman et al. | 361/605 |
| 3,360,752 | A * | 12/1967 | Uptegraff, Jr. | 336/59 |
| 3,371,458 | A * | 3/1968 | Sturgill | 52/651.01 |
| 3,621,339 | A * | 11/1971 | Hodgson | 361/678 |
| 3,832,605 | A * | 8/1974 | Clark, Jr. | 174/481 |
| 3,896,353 | A * | 7/1975 | Burton et al. | 361/609 |
| 3,925,679 | A * | 12/1975 | Berman et al. | 290/1 R |
| RE30,229 | E * | 3/1980 | Berman et al. | 290/1 R |
| 5,072,554 | A * | 12/1991 | Hayman | 52/79.1 |
| 5,315,794 | A * | 5/1994 | Pearson | 52/79.1 |
| 5,555,681 | A * | 9/1996 | Cawthon | 52/63 |
| 6,016,634 | A * | 1/2000 | Sayer | 52/648.1 |
| 6,082,070 | A * | 7/2000 | Jen | 52/650.3 |
| 6,250,022 | B1 * | 6/2001 | Paz et al. | 52/79.5 |
| 6,321,501 | B1 * | 11/2001 | Ignash | 52/645 |
| 6,418,672 | B1 * | 7/2002 | Hampel | 52/79.1 |
| 6,634,152 | B1 * | 10/2003 | Pilkinton | 52/641 |
| 6,892,497 | B2 * | 5/2005 | Moon et al. | 52/79.1 |
| 7,395,634 | B2 * | 7/2008 | Anderson et al. | 52/79.1 |
| 7,543,411 | B2 * | 6/2009 | Whitehead et al. | 52/66 |
| 7,581,357 | B2 * | 9/2009 | Richardson et al. | 52/79.5 |
| 7,877,936 | B2 * | 2/2011 | Uffner et al. | 52/90.1 |
| 2004/0216395 | A1 * | 11/2004 | Wentworth, Jr. | 52/79.5 |
| 2005/0257439 | A1 * | 11/2005 | Sarver et al. | 52/79.1 |
| 2005/0279034 | A1 * | 12/2005 | Tsang | 52/79.1 |
| 2005/0284035 | A1 * | 12/2005 | DeOvando et al. | 52/79.1 |
| 2007/0094979 | A1 * | 5/2007 | Richardson et al. | 52/578 |
| 2007/0175108 | A1 * | 8/2007 | Stein et al. | 52/79.5 |
| 2008/0256878 | A1 * | 10/2008 | Berns et al. | 52/79.6 |
| 2009/0229194 | A1 * | 9/2009 | Armillas | 52/79.1 |
| 2011/0061338 | A1 * | 3/2011 | Hunter | 52/848 |
| 2011/0179722 | A1 * | 7/2011 | Schulz et al. | 52/79.1 |

FOREIGN PATENT DOCUMENTS

| | | | |
|---|---|---|---|
| DE | 19650931 | 6/1998 | H02B 7/00 |
| DE | 19650931 A1 | 6/1998 | H02B 7/00 |
| EP | 0592757 | 4/1994 | E04H 5/04 |
| EP | 1 443 156 | 8/2004 | E04C 2/38 |
| PL | 180976 | 5/2001 | H02B 7/06 |
| PL | 180976 B1 | 5/2001 | H02B 7/06 |

OTHER PUBLICATIONS

Written Opinion of the International Searching Authority mailed Nov. 29, 2011 in corresponding application PCT/PL2010/000038.

International Search Report in priority application No. PCT/PL2010/000038 mailed Sep. 26, 2011.

* cited by examiner

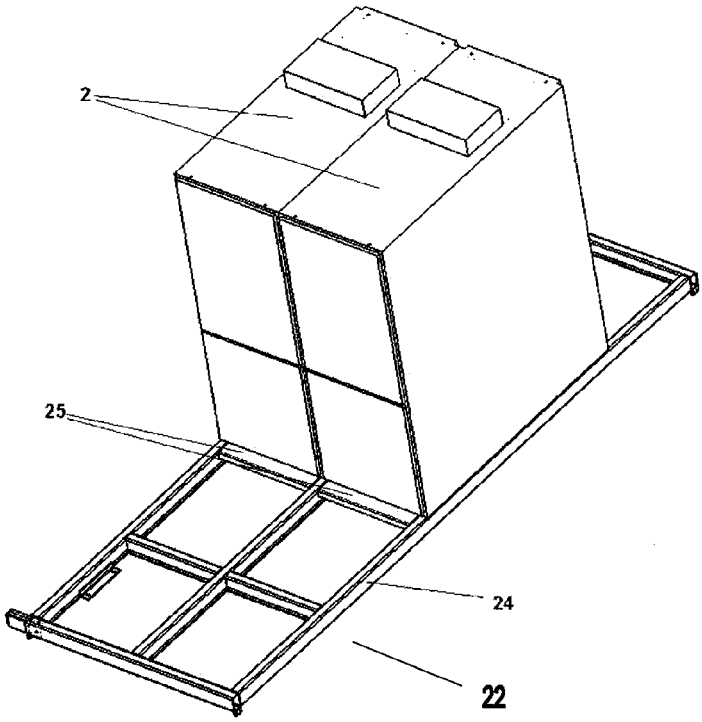
Fig.7
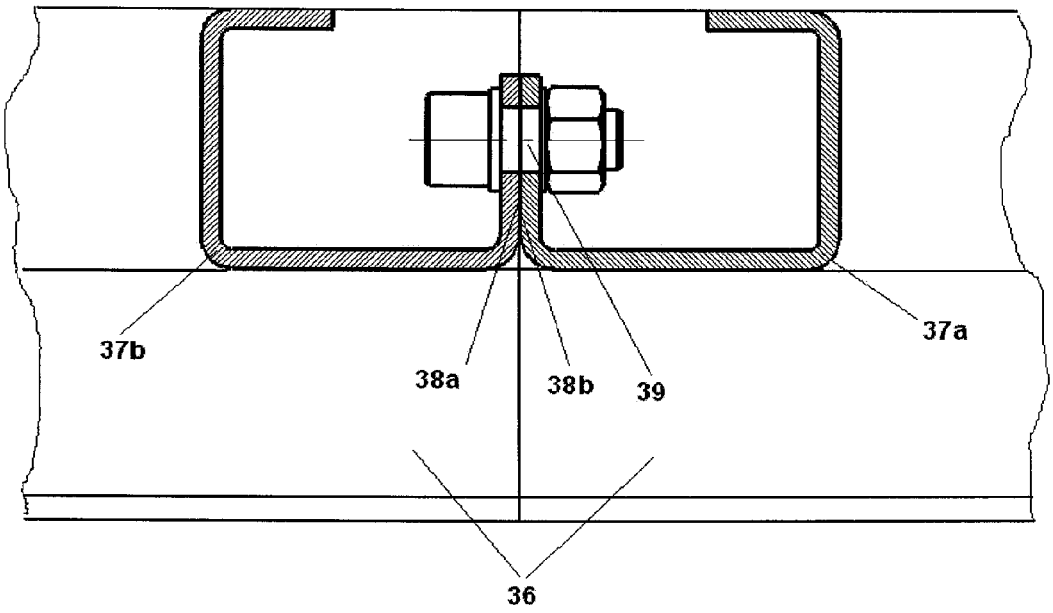
A-A Fig.16

ENCLOSURE FOR SECONDARY DISTRIBUTION MODULAR SWITCHGEARS

TECHNICAL FIELD

The subject of the invention is an enclosure for secondary distribution modular switchgears, applicable in protecting switchgears both against adverse weather conditions and against unauthorized inspections of high, medium and low voltage switch gear, and also against accidental access by unauthorized persons, or by wild animals and birds.

BACKGROUND ART

At present, power distribution substations are made as monolithic structures, taking the form of containers or buildings. Such concept brings about a number of inconveniences, mainly due to quite large external dimensions of the finished facilities and limited possibilities of prefabrication. The modular substation enclosure which is the subject of this patent application allows to shorten the time of design and construction, and thereby to reduce the costs. In addition, the small dimensions of individual components make their galvanic corrosion protection possible, and the unique concept of the external plating combined with the applied technical solutions considerably reduce the number of heat bridges, which results in good thermal insulation.

SUMMARY OF THE INVENTION

The enclosure according to the invention comprises a base-frame to which the enclosure walls are fixed, and it is provided with a cover in the form of a roof. The inventive enclosure is characterized in that the base-frame is made from a metal truss and it contains two extreme base-frame modules: the left one and the right one, and at least one middle triple and/or double module, which are connected with one another by means of a pair of permanent connections formed by a socket and a prong, and one left and one right fastening and grounding plates.

At least a single switchgear panel is fixed in the windows of the base-frame truss.

The windows of the base-frame truss have their internal dimensions adjusted to the dimensions of a single switchgear module, while the width of the window "W" corresponds to the width of one panel of the modular switchgear, and the length of the window "L" corresponds to the length of the panel of the modular switchgear.

The sockets are situated in the extreme left module of the base-frame, and the prongs are situated in the middle module of the base-frame, on one side of the module, while on the other side of the middle module of the base-frame there are situated sockets, and in the extreme right module of the base-frame there are situated prongs.

A skid frame is fixed to the base-frame, and the skids are fastened to brackets that are placed in each module of the base-frame in the truss windows.

The brackets are made of angle irons which are permanently fastened to the inner surface of the window of the truss that forms the base-frame.

Floor covering plates containing cut-outs are fixed in the windows of the base-frame truss.

The enclosure walls are fixed to the enclosure base-frame through a base beam which is a part of each wall module.

The base beam is made of a bent profile, and at least one extreme left vertical beam or one extreme right vertical beam is fastened to the flat upper surface of the base beam.

The extreme vertical beams belonging to different modules of the enclosure walls are connected with one another by means of fixing bolts which are placed in openings made in the surface margins being in contact with the adjacent mirrored parts of the vertical beams.

BRIEF DESCRIPTION OF THE DRAWINGS

The subject of the invention is presented as an embodiment in the drawing where.

BEST MODE FOR CARRYING OUT THE INVENTION

Figure 1:
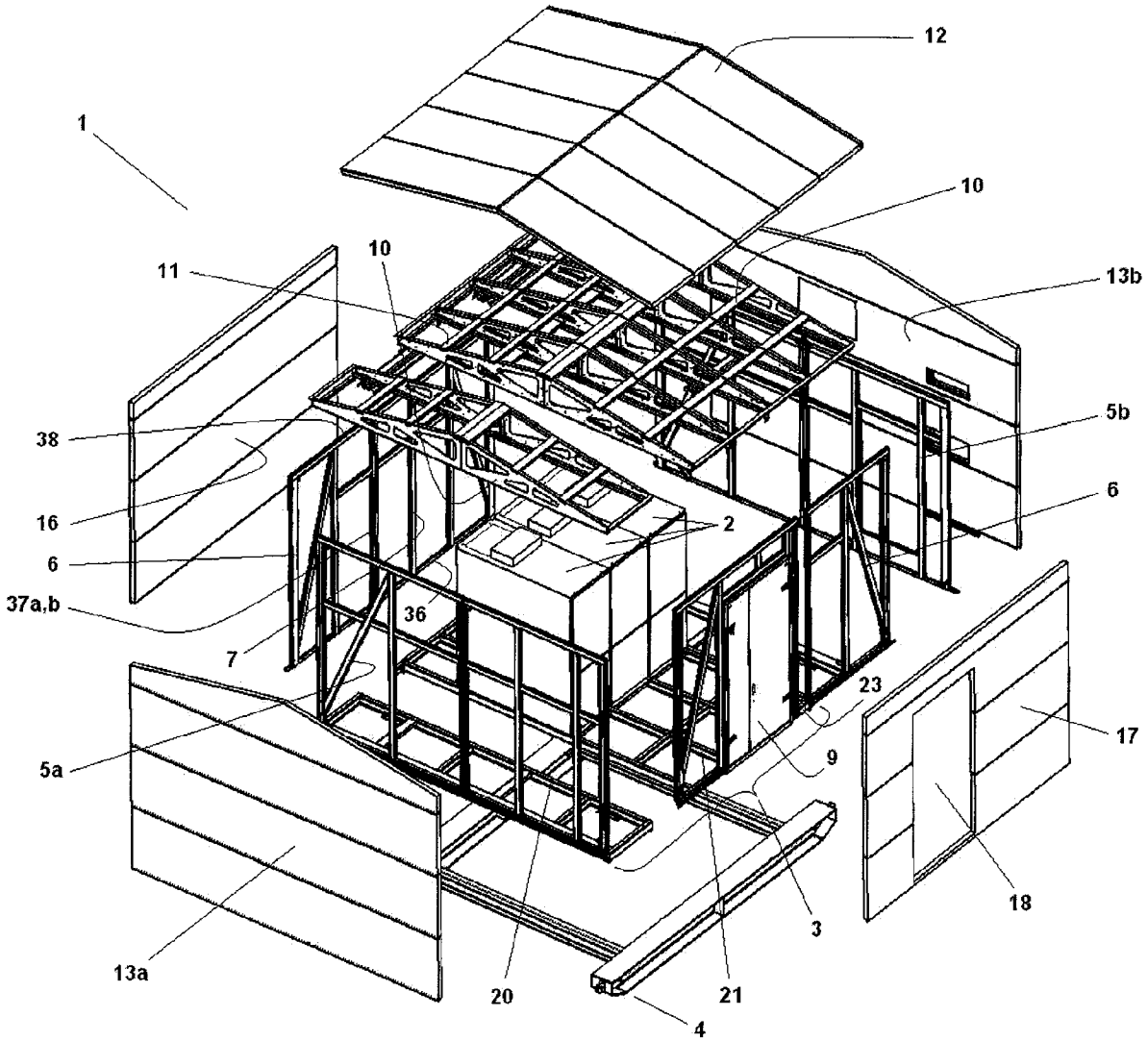
FIG. 1 shows the enclosure for secondary distribution modular switchgears in an exploded view, FIG. 2—a complete enclosure in a perspective view from the corner right side in the basic embodiment of the invention, FIG. 3—the complete enclosure from FIG. 2 in a perspective view from the corner left side, FIG. 4—the complete enclosure from FIG. 2 in a perspective view from the bottom side, FIG. 5—the complete enclosure in a perspective view from the corner right side in one of the preferred embodiments of the invention, FIG. 6—the middle three-column module of the base-frame with the switchgear panels in the basic embodiment of the invention in a perspective view, FIG. 7—the middle two-column module of the base-frame with the switchgear panels in a perspective view, FIG. 8—the extreme, left module of the base-frame in a perspective view, FIG. 9—the extreme right module of the base-frame in a perspective view, FIG. 10—the connection between the modules of the base-frame from the right side in an exploded view, FIG. 11—the connection between the modules of the base-frame from the left side in an exploded view, FIG. 12—the skid frame of the enclosure from FIG. 1 in a perspective view in the basic embodiment of the invention, FIG. 13—a fragment of the base of the enclosure from FIG. 1 including a part of the extreme left module of the base-frame and a part of the middle module and a fragment of the skid frame, in a perspective view, FIG. 14—a fragment of the base of the enclosure from FIG. 1 with a floor cover with two cut-outs, and with a floor cover with one cut-out in an exploded view, FIG. 15—a fragment of the connection between the modules of the walls of the enclosure from FIG. 1 from the inner side of the enclosure, including the extreme left vertical beam and the extreme right vertical beam, and the base beam of the wall frame, in an exploded view, FIG. 16—a fragment of the vertical beams from FIG. 15 in a cross-section, with a fragment of the base beams and a bolt connecting the vertical beams, FIG. 17—a fragment of the vertical beams from FIG. 1 with a fragment of the horizontal beams of the walls in an exploded view, FIG. 18—a schematic presentation of a 3-module enclosure, showing the base, the roof and the front wall, FIG. 19—a schematic presentation of a 4-module enclosure, showing the base, the roof and the front wall, FIG. 20—a schematic presentation of a 5-module enclosure, showing the base, the roof and the front wall, FIG. 21—a schematic presentation of a 6-module enclosure, showing the base, the roof and the front wall, FIG. 22—a schematic presentation of a 7-module enclosure, showing the base, the roof and the front wall, FIG. 23—a schematic presentation of an 8-module enclosure, showing the base, the roof and the front wall, FIG. 24—a schematic presentation of a 9-module enclosure, showing the base, the roof and the front wall, FIG. 25—a schematic presentation of a 10-module enclosure, showing the base, the roof and the front wall, FIG. 26—a schematic presentation of an 11-module enclosure, showing the base, the roof and the front wall.
Figure 2:
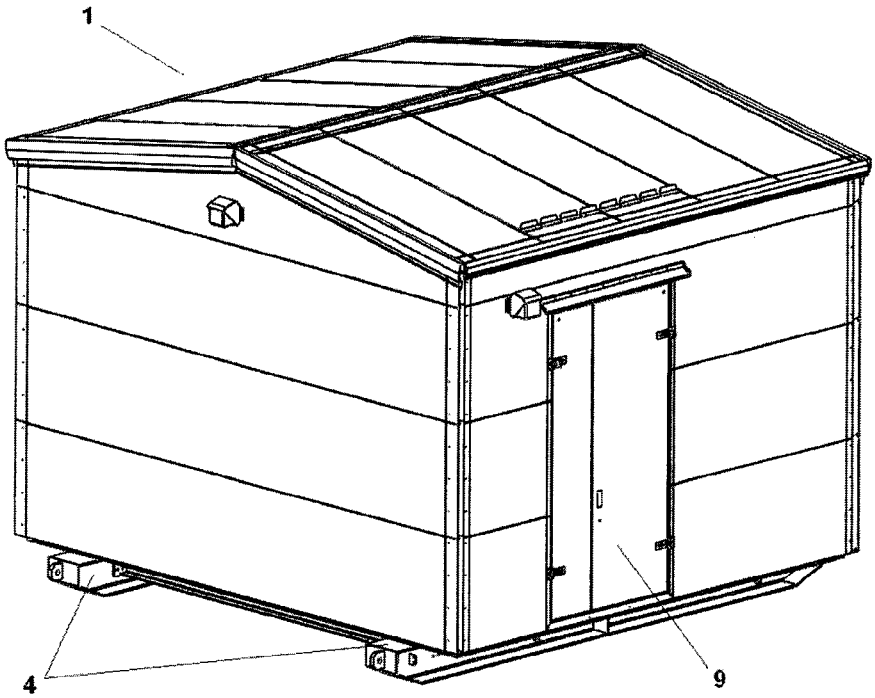
Figure 3:
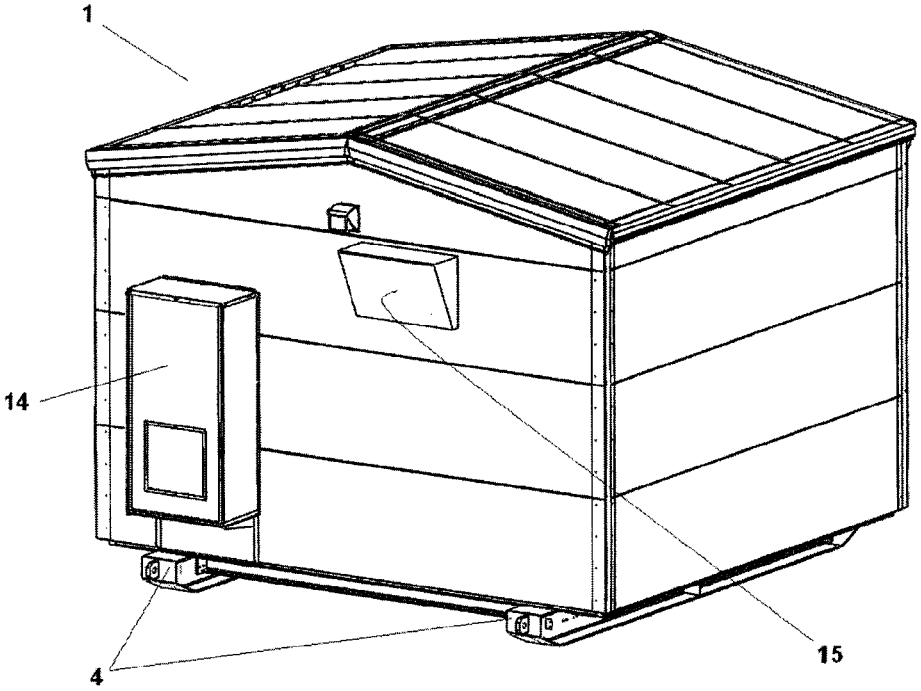
Figure 4:
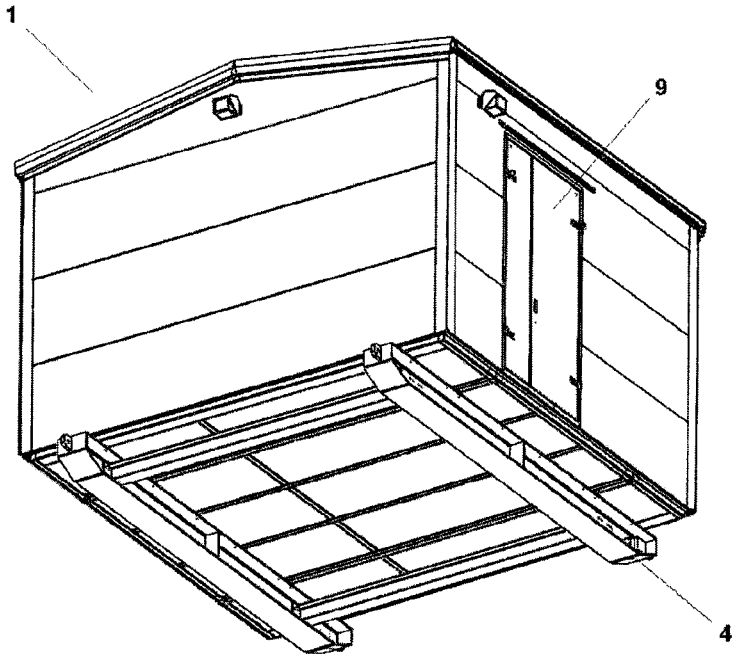
Figure 12:
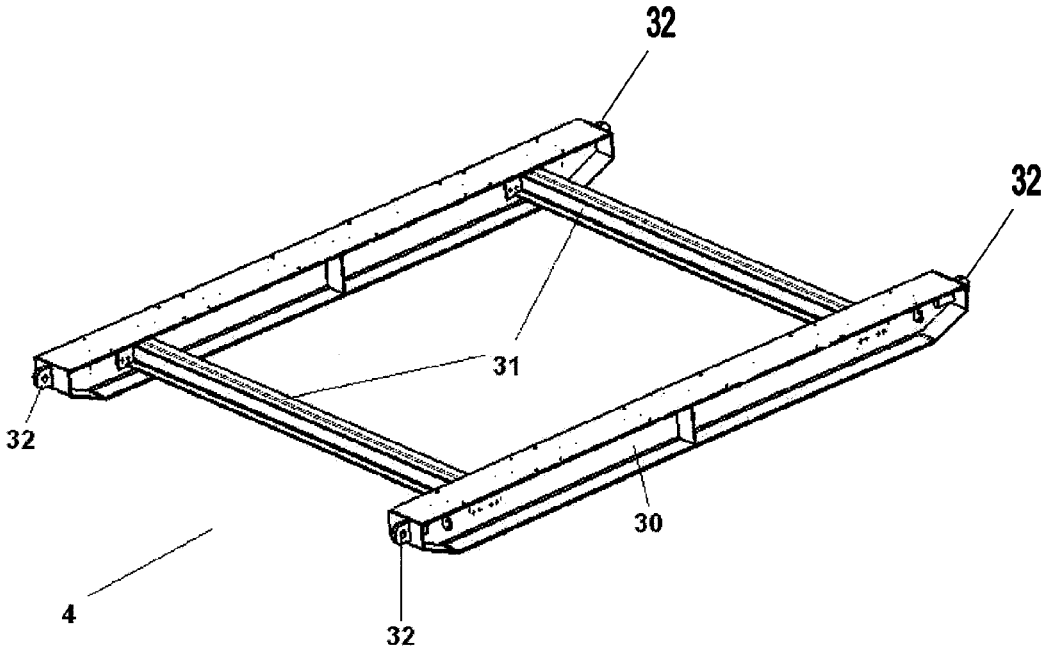
Figure 5:
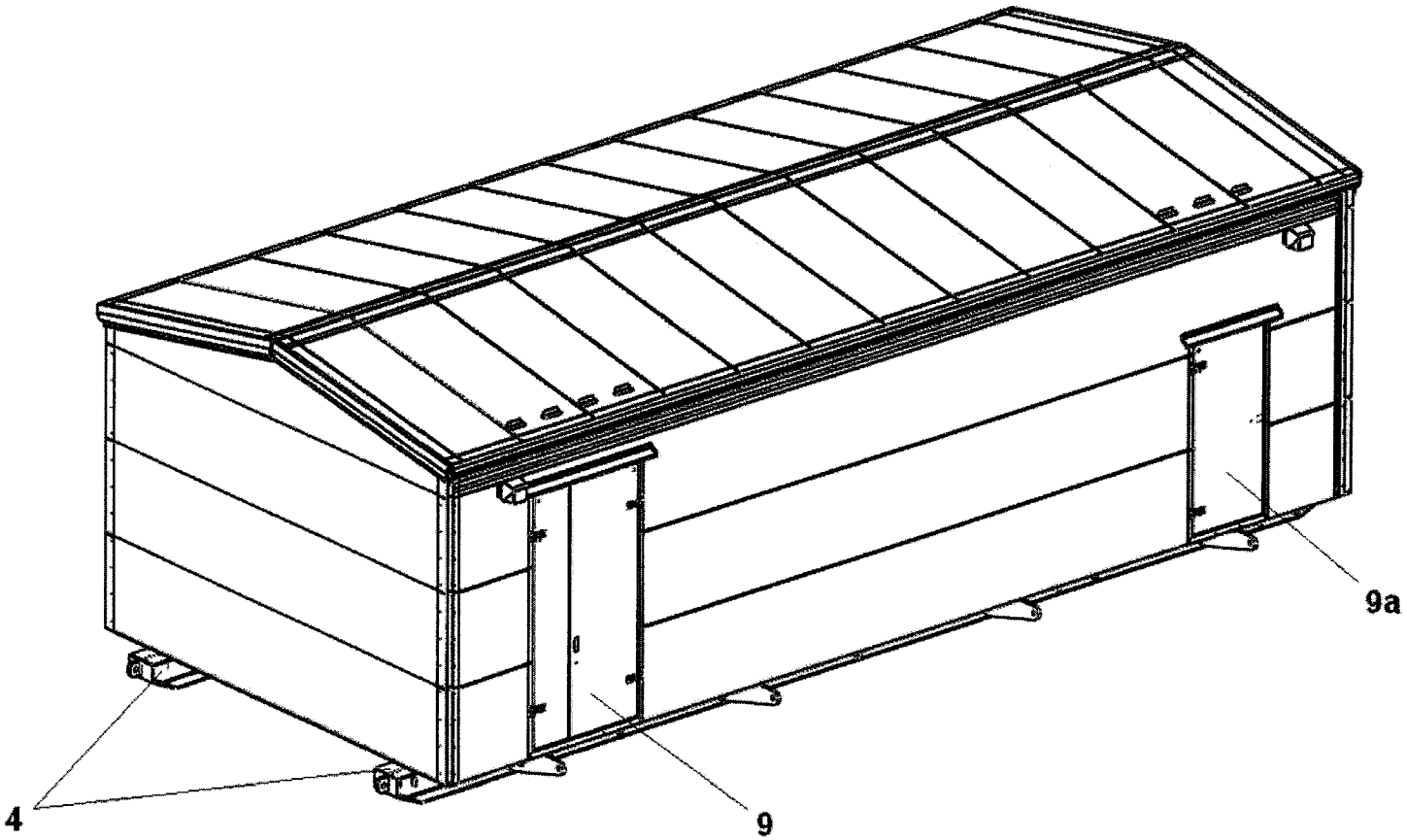
Figure 20:
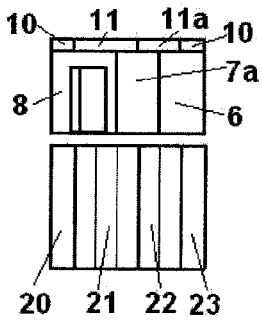
Figure 21:
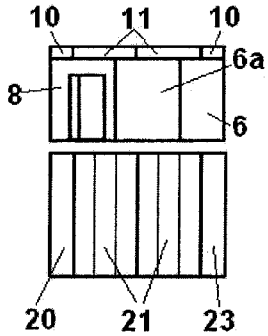
Figure 22:
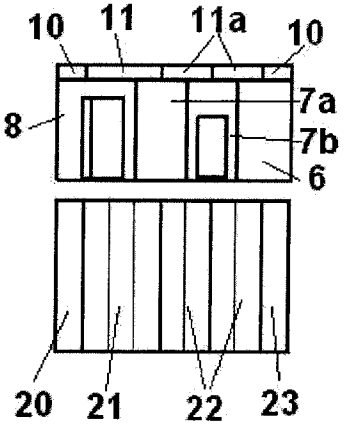
Figure 25:
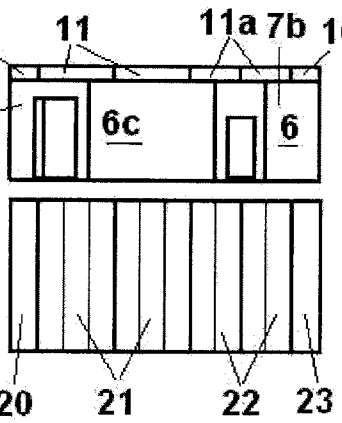

The enclosure 1 for the panels 2 of a secondary distribution modular switchgear contains a base-frame 3 in the form of a metal truss to whose bottom side a metal skid frame 4 is fixed, and to its upper side metal frame structures of the enclosure outer walls are fixed, which structures are comprised of the modules of the left 5*a* and right 5*b* gable walls, extreme double wall modules 6, a triple wall module 7 or, not shown in FIG. 1, two-column wall module 7*a* (FIG. 20), or, also shown in FIG. 19-26, combinations of double and triple modules, or a mutual combination of double modules or only triple modules. One of the triple modules 8 of the front wall of the enclosure 1 has service door 9 fixed in it. Another service door 9*a* (FIG. 5) can also be placed in the right extreme triple module 6*b*, which is shown in FIG. 5 and FIG. 23, 24, 26, or in a double wall module 7*b*, which is schematically shown in FIG. 22 and FIG. 25. Two extreme skeleton constructions of single roof panels 10 and a triple panel 11 comprised of three single roof panels are fastened to the frame structures of the outer walls. The middle roof panel can be also comprised of a double roof panel 11*a*, which is not shown in FIG. 1, but is presented schematically in FIGS. 19, 20, 22, 23, 25 and 26. The extreme roof panels together with the middle panels which can be a combination of panels consisting of single roof panels as well as two- and three-column panels, which is schematically shown in FIG. 18-26, are connected with one another forming the metal framework of the roof structure of the enclosure 1. The roof structure framework is covered by an external roofing 12. The wall modules 5*a* and 5*b* of the enclosure 1 gable walls are covered with gable wall plating 13*a* and 13*b*. In the plating of the gable wall 13*b* there are openings that enable the installation of an air conditioner unit 14 and the outlet of a post-arc gas blow-off channel 15, which have been shown in FIG. 3. The extreme module 6 and the triple module 7 are covered with the rear wall plating 16, and the extreme module 6 and the module 8 are covered with the front wall plating 17 which is provided with an opening 18 for the service door 9. The front and rear walls of the enclosure 1, if they are made of other combinations of double and triple modules, are covered with plating whose dimensions are adjusted to the dimensions of the external walls of the enclosure. In another embodiment of the invention presented in FIG. 5, in the external plating of the front wall there is an additional opening 19 for another service door 9*a*.

Figure 6:
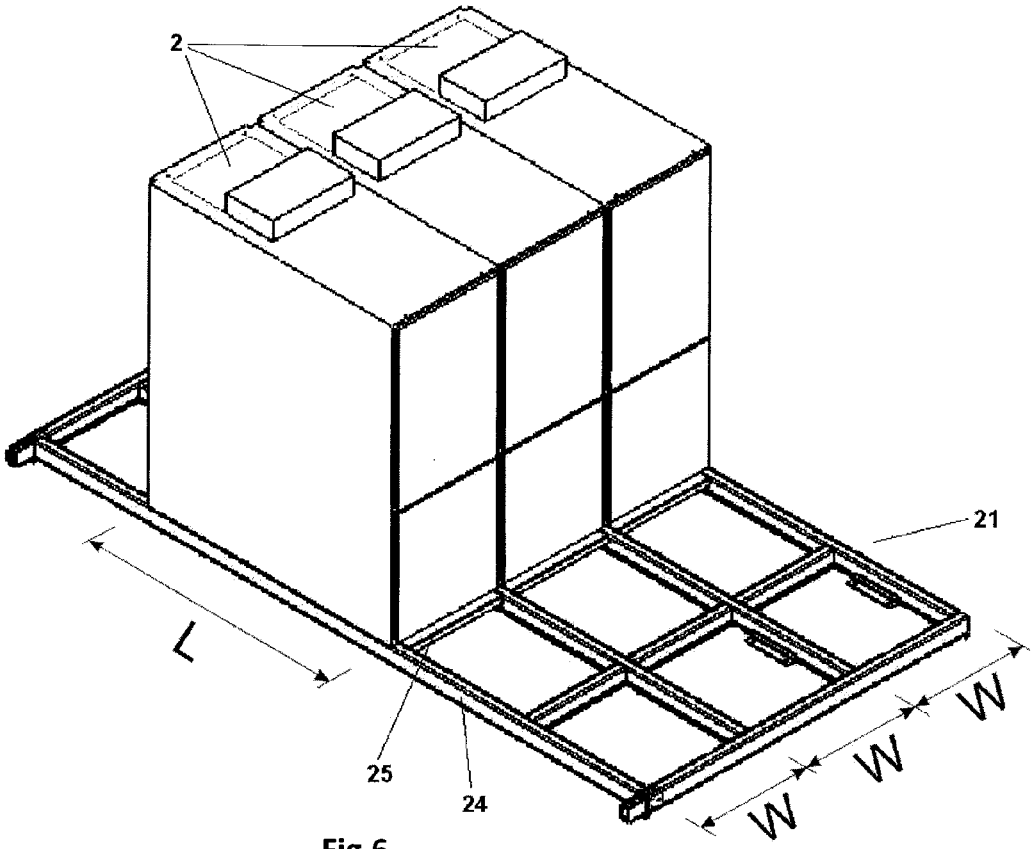
Figure 13:
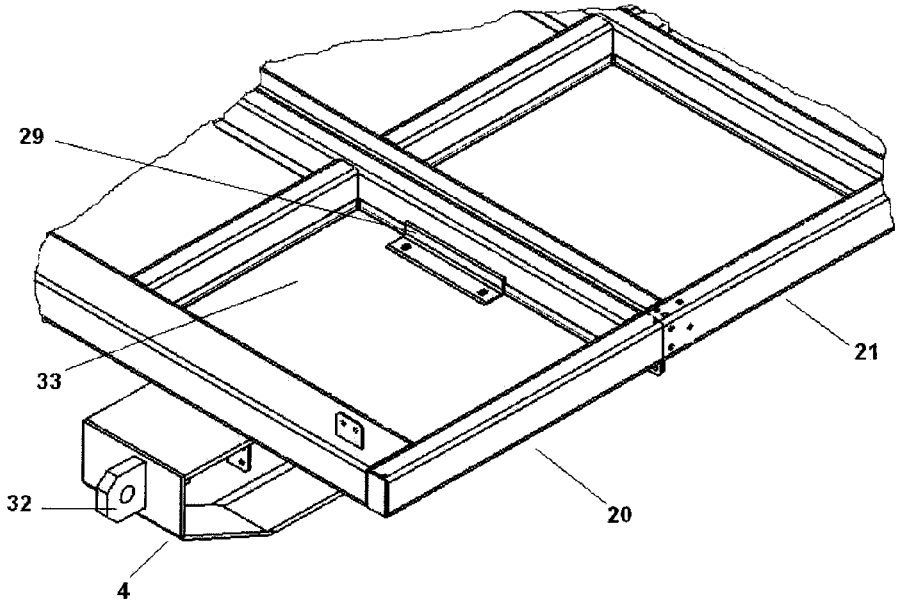
Figure 8:
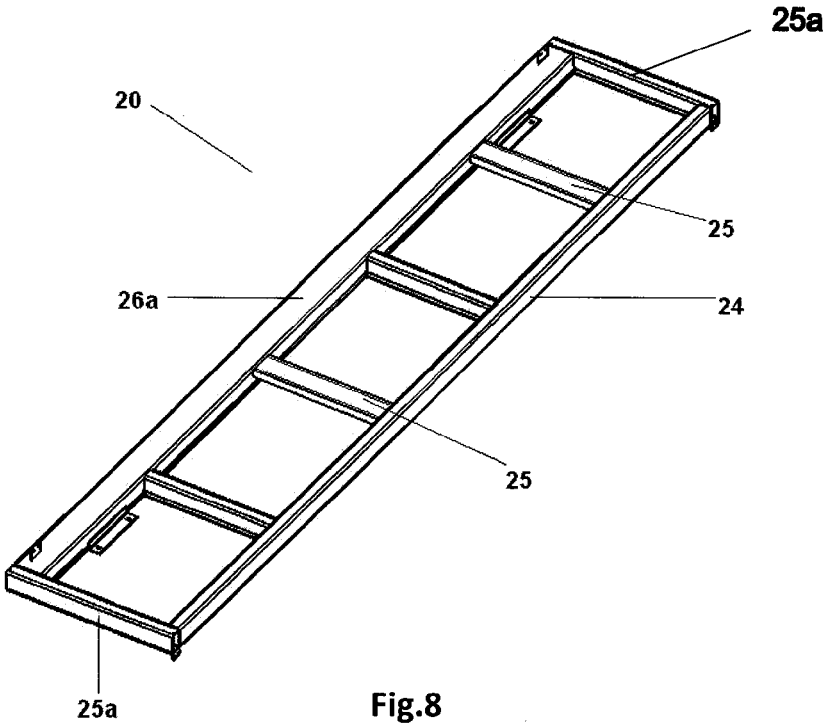
Figure 9:
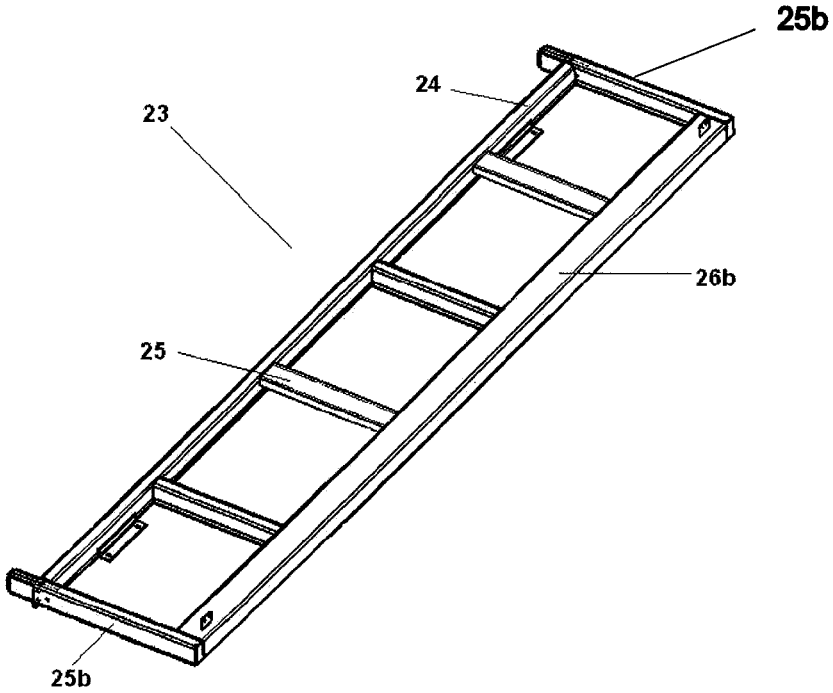
Figure 10:
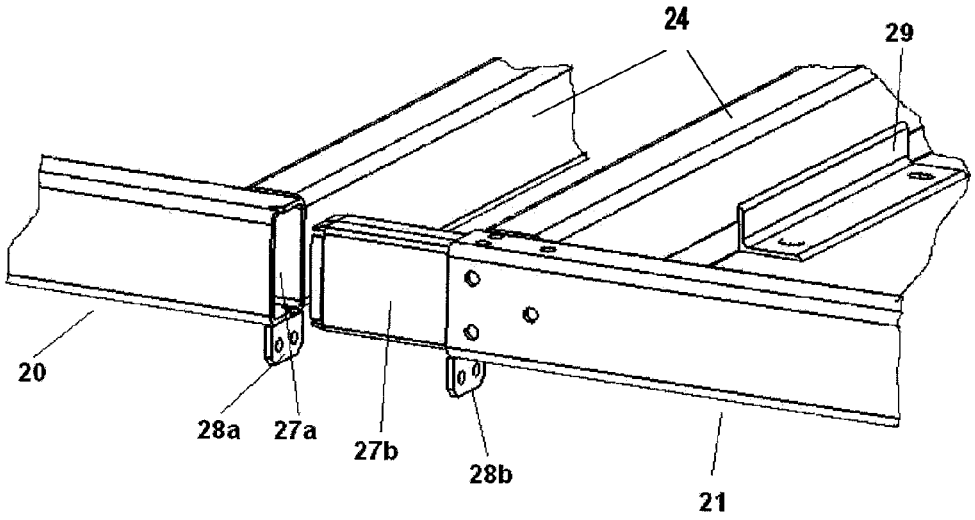
Figure 11:
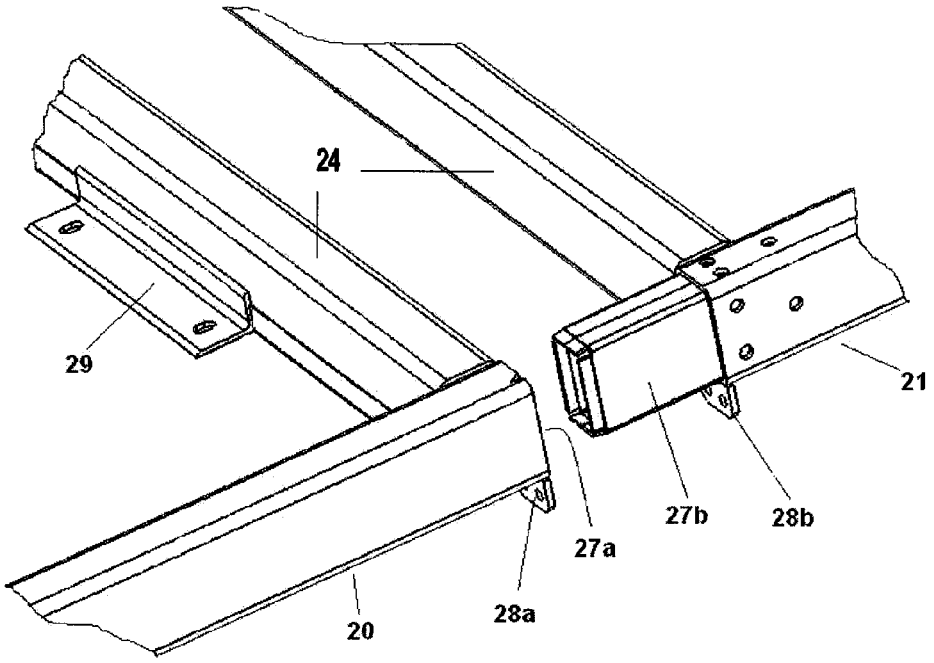
Figure 14:
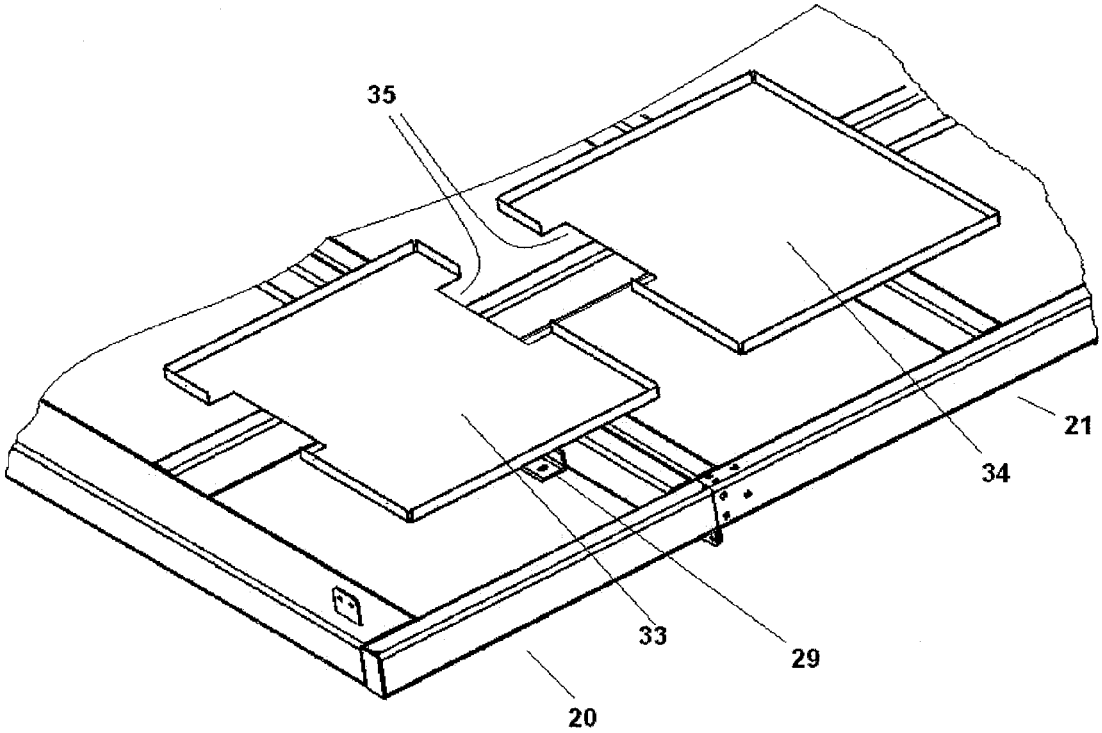
Figure 18:
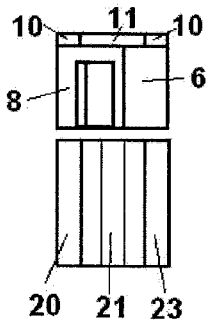
Figure 19:
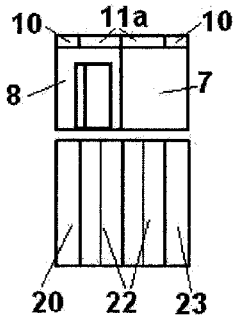
Figure 15:
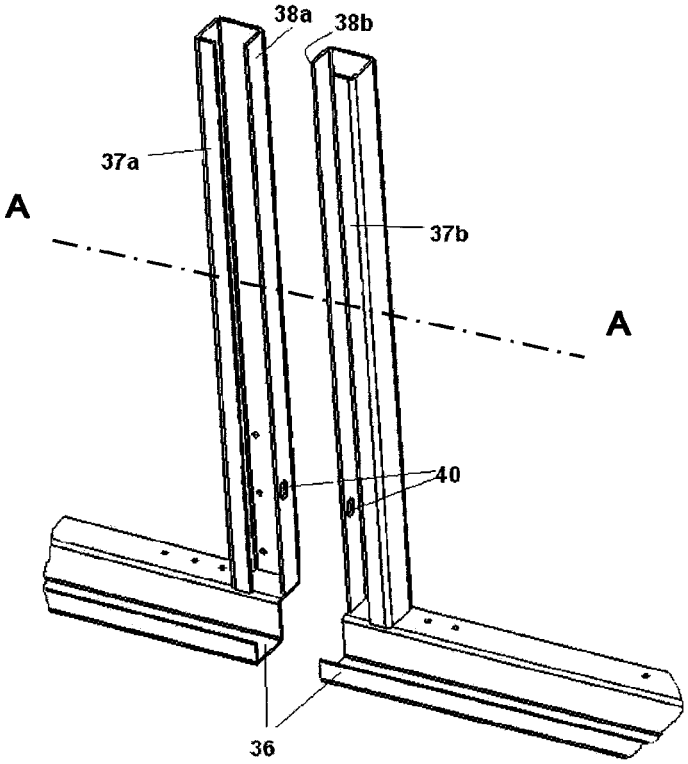
Figure 17:
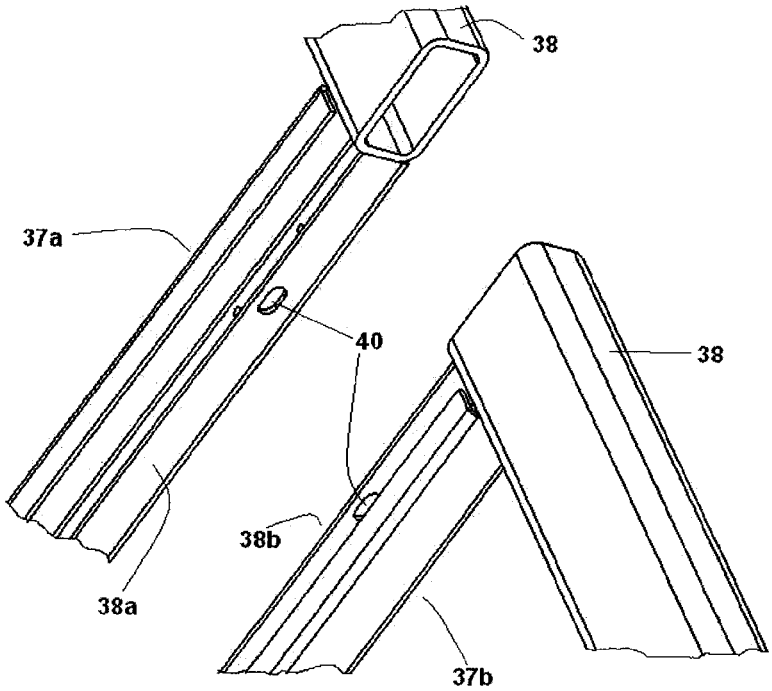

The base-frame 3 of the enclosure 1 comprises an extreme left base-frame module 20, a middle three-column base-frame module 21 (FIG. 1, FIG. 18) and an extreme right base-frame module 23*c* (FIG. 9). In other embodiments of the invention the middle three-column base-frame module 21 is connected with a middle two-column module 22, which is shown in FIG. 7 and schematically in FIGS. 20, 22, 23, 25 and 26. Instead of the middle three-column module of the base frame 21 also two two-column middle modules 22 connected with each other can be used (FIG. 19). The base modules 20, 21, 22 and 23 are made in the form of trusses comprised of longitudinal beams 24 forming the truss columns and crosswise beams 25 forming the truss rows, and in the external modules 20 and 23, the left 26*a* (FIG. 8) and right 26*b* (FIG. 9) longitudinal beams are wider compared with the other longitudinal beams 24, and the external left 25*a* (FIG. 8) and right 25*b* (FIG. 9) crosswise beams after connection with one another form a permanent connecting element of the modules. The base modules, and especially the middle module 21 and/or 22 are intended for founding in them single switchgear panels 2 which are placed in the internal truss windows in such way that the width of an individual truss window "W" is equal to the width of a single switchgear panel 2, which is the shorter side of this panel, while the length of the truss window "L" measured in the direction parallel to the longitudinal beams 24 is adjusted to the external dimensions of the switchgear panel 2 and it is equal to the length of the longer side of a single panel of this switchgear. In the surroundings of each switchgear panel 2, in order to allow the switchgear personnel easy movement inside the enclosure 1 during repair or service work, at least one truss window in which no switchgear panels are located is situated parallel to the width "W" of the switchgear panel 2. In the presented embodiment (FIG. 6) the middle three-column module 21 is suitable for placing in it a switchgear consisting of three switchgear panels 2 in a row, but the middle module can be adjusted to placing in it one or two switchgear panels, as shown in FIG. 7. Moreover, the middle module can be a combination of two- and/or three-column modules adjusted to the operating requirements. The middle module 21 or 22 is connected with the module 20 and with the module 23 by means of two pairs of joints fitted to each other in a sliding way, where each pair is a joint of the prong 27*b* and socket 27*a* type, and then connected with each other in a separable way by means of fastening and grounding plates 28*a*, 28*b* fixed respectively to the bottom side of the external truss beams 25*a*, 25*b* and the bolt connections not shown in the drawing. The prong 27*b* has the form of a section of a rectangular-cross-section tube which is placed inside the cross-wise beam 25*b* and has a cross-section similar to the cross-section of the external crosswise beam 25*b* which is a tube of a rectangular cross-section. The prong 27*b* is fixed to the crosswise beam 25*b* by means of any permanent joint such as welding. The socket 27*a* is located in the external beam 25*a*, which is a tube of a rectangular cross-section. The cross-section of the socket 27*a* is adjusted to the cross-section of the prong 27*b*, so that when the prong 27*b* is inserted into the socket 27*a* the contact surfaces of the socket and the prong fit to one another in a sliding way. In the base-frame 3 of the enclosure 1, in the external windows of the trusses of the modules 20, 21, 22, 23, in which switchgear panels are not located, there is fixed at least one bracket 29 which has the form of angle irons which are welded to the longitudinal beams 24 situated parallel to each other. Steel skids 30 of the skid frame 4 which are connected with each other by rigid crossbars 31 of the skid frame 4 are attached to the brackets 29. The skids 30 are provided with lugs 32 that facilitate the transport of the enclosure 1 founded on the base frame 3. In the truss windows situated directly above the skids 30 there are fixed floor covers in the form of troughs 34 containing one cut-out 35, or troughs 33 containing two cut-outs 35. The shape of the cut-outs 35 is adjusted to the shape of the brackets 29. The other windows of the truss are filled with full floor plates, which are not shown in detail in the drawing. The side walls of the enclosure 1 are built of metal frame modules 5*a*, 5*b*, 6, 7, 8 whose width is adjusted to the external dimensions of the base in such way that the length of the frames of the left 5*a* and right 5*b* gable wall modules is equal to the width of the base-frame 3, the length of the extreme double wall modules 6 in the front and rear walls equals the width of the middle, two-column base module 22 and the width of at least one three-column module of the base-frame 23 or at least two two-column base-frame modules 22. The width of the front and rear wall frames of the enclosure 1 depends on the number and type of the modules of the base-frame 3 used in the given embodiment of the enclosure 1. Each of the wall frames contains a horizontal base beam 36 of the wall frame with a left 37*a* and a right 37*b* extreme vertical beams welded to it, to which beams external horizontal wall beams 38 are welded (FIG. 17). Depending on the situation of the wall modules in relation to the enclosure 1 walls any types of bracing are used to connect internally the vertical and horizontal beams of the frames in order to increase the rigidity of the wall modules, which is of no significance to the essence of the invention and can be achieved in any way. The horizontal base beam 36 is made of a bent profile whose cross-section has the shape of two scalene angle irons connected with each other in such way that to the longer horizontal arm of one of the angle irons constituting the bottom support of the beam 36 there is attached vertically one arm of the second angle iron rotated 90 degrees in relation to the horizontal arm of the first angle iron in clockwise direction for walls situated on the right side of the enclosure 1, or rotated counterclockwise for walls situated on the left side of the enclosure 1. The other arm of the second angle iron is situated parallel to the bottom support and it constitutes the upper support for the horizontal beam 36, bent in the same direction as the arm of the first angle iron. The bottom support of the horizontal beam 36 is attached to the external base beams 3 by bolting or welding, which is not shown in the drawing. The extreme vertical beams 37*a*, 37*b* (FIG. 15) of the frames of the wall modules, belonging to different panels forming the structure of the enclosure 1 walls, have their cross-sections in the form of a rectangle partly open on one side, with the opening situated near the external left 38*a* and right 38*b* surface margins. The external margins of one beam 38*a* belonging to one of the modules contact the surface margins 38*b* of the mirror image of the second beam and they are connected with each other by means of fixing bolts 39 (FIG. 16) placed in openings 40 of the vertical beam and tightened from the inner side of the enclosure 1, which is the reason why the external side of the joined vertical beams does not have external prongs. The horizontal beams 38 in the form of metal tubes of rectangular cross-section are welded to the upper surface of the vertical beams. The structural elements of the roof consisting of roof modules whose dimensions are adjusted to the structure of the wall modules are attached to these tubes.

For the operating conditions of the invention, the modular structure of the enclosure is made in many variants. The basic variant comprising two single extreme modules of the base-frame, the left one 20 and the right one 23, and one middle triple module 21, is presented in detail in the invention embodiment in FIG. 1 and schematically in FIG. 18. The headwall of this enclosure contains a triple module of the front wall 8 with the service door 9 and the extreme double wall module 6, and the roof contains two single roof panels 10 and the middle triple roof module 11.

Another variant of the embodiment of the inventive enclosure, presented in FIG. 19, contains the base frame 3 formed by two single extreme modules of the base-frame, the left one 20 and the right one 23, two middle two-column modules of the base-frame 22. The headwall of this enclosure contains the front wall triple module 8 with the service door 9 and the extreme triple wall module 7, and the roof contains two single roof panels 10 and two double roof panels 11*a*.

In still another embodiment of the enclosure according to the invention, presented in FIG. 20, the base-frame 3 contains two extreme single base-frame modules, the left one 20 and the right one 23, one middle triple module 21, and one middle two-column base-frame module 22. The headwall of this enclosure contains the front wall triple module 8 with the service door 9 and one two-column wall module 7*a* and one extreme double wall module 6. In this embodiment of the invention, the roof contains two single roof panels 10, one middle triple roof panel 11 and one double roof panel 11*a*.

In the embodiment of the invention shown in FIG. 21, the base-frame 3 contains two single base-frame modules, the left one 20 and the right one 23, and two middle triple modules 21. The headwall of this enclosure contains the triple module of the front wall 8 with the service door 9 and one triple wall module 6*a* and one extreme double wall module 6. The roof includes two single roof panels 10 and two triple roof panels 11.

In still another embodiment of the invention presented in FIG. 22, the base-frame 3 contains two extreme single base-frame modules, the left one 20 and the right one 23, one middle triple module 21, and two middle two-column base-frame modules 22. The headwall of this enclosure contains the triple module of the front wall 8 with the service door 9, one two-column wall module 7*a*, one double wall module with the door 9*a*, and one extreme double wall module 6. The roof contains two single roof modules 10, the triple roof panel 11, and one double roof panel 11*a*.

Figure 23:
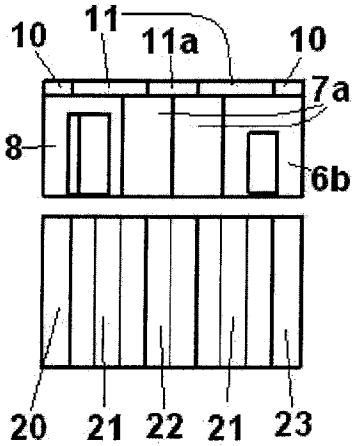

In still another embodiment of the invention presented in FIG. 23, the base frame 3 contains two extreme single base-frame modules, the left one 20 and the right one 23, two middle triple modules 21, and one middle two-column base-frame module 22. The headwall of this enclosure contains the triple module of the front wall 8 with the service door 9, two two-column wall modules 7*a*, and one extreme triple wall module with a door 6*b*. The roof contains two single roof panels 10, two triple roof panels 11, and one double roof panel 11*a*.

Figure 24:
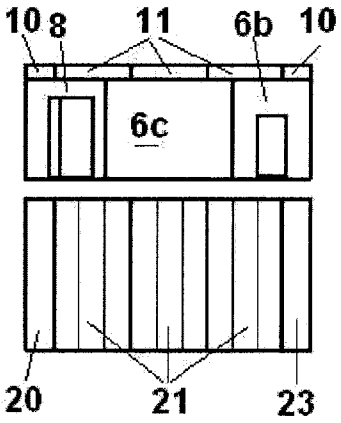

In still another embodiment of the invention presented in FIG. 24, the base frame 3 contains two extreme single base frame modules, the left one 20 and the right one 23, and three middle triple modules 21. The headwall of this enclosure contains the triple module of the front wall 8 with the service door 9, one fivefold wall module 6*c*, and one extreme triple wall module with the door 6*b*. The roof contains two single roof panels 10 and three triple roof panels 11.

In still another embodiment of the invention presented in FIG. 25, the base-frame 3 contains two extreme single base-frame modules, the left one 20 and the right one 23, two middle triple modules 21, and two middle two-column base frame modules 22. The headwall of this enclosure contains the triple module of the front wall 8 with the service door 9, one fivefold wall module 6*c*, one double wall module with a door 7*b*, and one extreme double wall module 6. The roof contains two single roof panels 10, two triple roof panels 11, and two double roof panels 11*a*.

Figure 26:
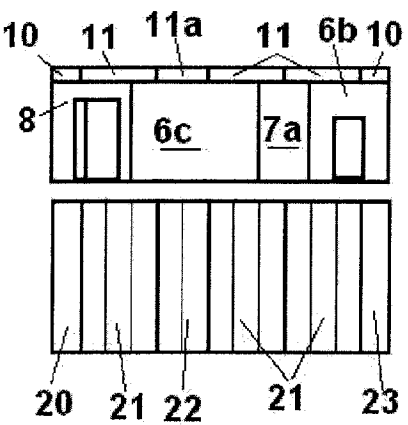

In still another embodiment of the invention presented in FIG. 26, the base-frame 3 contains two extreme single base-frame modules, the left one 20 and the right one 23, three middle triple modules 21, and one middle two-column base-frame module 22. The headwall of this enclosure contains the triple module of the front wall 8 with the service door 9, one fivefold wall module 6*c*, one two-column wall module 7*a*, and one extreme triple wall module with the door 6*b*. The roof contains two single roof panels 10, three triple roof panels 11 and one double roof panel 11*a*.

The presented embodiments of the invention do not illustrate all possible embodiments of the enclosure, but they present practical and most frequently applicable embodiments. Construction of other enclosures in a different configuration of individual components is also possible, which is not shown in the drawing.

LIST OF THE NUMERICAL SYMBOLS IN THE DRAWING

1—enclosure
2—switchgear panel
3—base-frame
4—skid frame
5*a*—left gable wall module
5*b*—right gable wall module
6—extreme double wall module
6*a*—triple wall module
6*b*—extreme right triple wall module with a door
6*c*—fivefold wall module
7—extreme triple wall module
7*a*—two-column wall module
7*b*—double wall module with a door
8—triple module of the front wall
9—service door
9*a*—the second service door
10—single roof panel
11—triple roof panel
11*a*—double roof panel
12—external roofing
13*a*—gable wall plating
13*b*—gable wall plating with openings
14—AC unit
15—outlet of the post-arc gas blow-off channel
16—rear wall plating
17—front wall plating
18—service door opening
19—additional opening for another service door
20—extreme left base-frame module
21—middle three-column base-frame module
22—middle two-column base-frame module
23—extreme right base-frame module
24—longitudinal beam
25—crosswise beam
25*a*—external left crosswise beam
25*a*—external right crosswise beam
26*a*—external left longitudinal beam
26*b*—external right longitudinal beam
27*a*—socket
27*b*—prong
28*a*—fastening and earthing plate
28*b*—fastening and earthing plate
29—bracket
30—skid
31—skid frame crossbar
32—lug
33—floor cover with two cut-outs
34—floor cover with one cut-out
35—cut-out in a floor cover
36—base beam of the wall frame
37*a*—extreme left vertical beam
37*b*—extreme right vertical beam
38—horizontal wall beam
38*a*—external left surface margin
38*b*—external right surface margin
39—fixing bolt
40—vertical beam opening

The invention claimed is:

1. Set for building an enclosure for secondary distribution modular switchgears, said set comprising wall elements to form enclosure walls, roof elements to form a roof, and a set of base-frame elements to form a base-frame composed of a metal truss, said enclosure walls being fixed on said base-frame and being covered by said roof to form said enclosure, said set for building an enclosure for secondary distribution modular switchgears being characterized in that said set of base frame elements comprises at least three separate metal truss base-frame modules, comprising permanent coupling elements and being connectable with one another by means of a pair of said permanent coupling elements, each said permanent coupling element formed by an enclosed socket associated with one of said modules and a prong associated with another of said modules and extending from said module so as to face said module with said enclosed socket, and corresponding fastening and earthing plates extending from said facing modules connected to each other with said prong fully received in said corresponding enclosed socket, wherein said fastening and earthing plates extend from a corresponding end of said coupling element that forms said enclosed socket and from a corresponding end of said coupling element from which said prong extends, said fastening and earthing plates positioned substantially adjacent one another and attached to one another when said prong is fully received in said corresponding enclosed socket, two of said modules forming the extreme base-frame modules, the left one and the right one and the at least third module forming the at least one middle module.

2. An enclosure as in claim 1 characterized in that at least one single switchgear panel is placed in a base-frame truss window formed in one of said truss base-frame modules.

3. The enclosure as in claim 2 characterized in that the windows of the base-frame truss have internal dimensions adjusted to the dimensions of a single switchgear panel, and the truss window width (W) corresponds to the width of one single switchgear panel, while the truss window length (L) corresponds to the length of the switchgear panel.

4. An enclosure as in claim 1 characterized in that the enclosed sockets are located in the extreme left base-frame module, and prongs are located in the middle base-frame module on one side of the module, while enclosed sockets are located on the other side of the middle base-frame module, and prongs are located in the extreme right base-frame module.

5. An enclosure as in claim 1 characterized in that a skid-frame is fastened to the base-frame and its skids are attached to brackets located in each base-frame module in the truss windows.

6. An enclosure as in claim 5 characterized in that the brackets are made of angle irons which are permanently fixed to the inner surface of the base-frame truss window.

7. An enclosure as in claim 1 characterized in that floor covers with cut-outs are fixed in the base-frame truss windows.

8. An enclosure as in claim 1 characterized in that the enclosure walls are fixed to the base-frame through a base beam which is a part of each wall module.

9. An enclosure as in claim 8, characterized in that the base beam is made from a bent profile, and at least one extreme left vertical beam or extreme right vertical beam is attached to the flat top surface of the base beam.

10. An enclosure as in claim 9, characterized in that the extreme vertical beams belonging to different wall modules of the enclosure are joined together by means of fixing bolts placed in openings that are made in surface margins being in contact with the adjacent mirrored part of the vertical beams.

11. The enclosure as in claim 1, characterized in that said base-frame modules are formed with at least two opposed beams connected at respective ends and in between by crosswise beams, wherein said opposed beams and said crosswise beams have a tube of rectangular cross-section which form said enclosed sockets and which receive a corresponding said prong which has a rectangular cross-section sized to be received in said enclosed socket.

* * * * *